US005803010A

United States Patent [19]

Roy et al.

[11] Patent Number: 5,803,010

[45] Date of Patent: Sep. 8, 1998

[54] WATERCRAFT HULL PROTECTIVE APPARATUS

[76] Inventors: James G. Roy, 3 Surrey La., Eliot, Me. 03903; Michael A. Roy, 60 Lake Ridge Dr., Taunton, Mass. 02780-6822

[21] Appl. No.: 730,852

[22] Filed: Oct. 17, 1996

Related U.S. Application Data

[60] Provisional application No. 60/008,037 Oct. 30, 1995.

[51] Int. Cl.[6] ..... B63B 59/02

[52] U.S. Cl. ..... 114/343; 114/219; 114/361

[58] Field of Search ..... 114/219, 140, 114/361, 343; 293/128

[56] References Cited

U.S. PATENT DOCUMENTS

| | | | |
|---|---|---|---|
| 3,055,022 | 9/1962 | Vallquist . | |
| 3,220,026 | 11/1965 | Lichti . | |
| 3,606,431 | 9/1971 | Kunevicius | 293/128 |
| 4,235,466 | 11/1980 | Mandrik | 293/128 |
| 4,667,619 | 5/1987 | Nishida | 114/361 |
| 4,756,266 | 7/1988 | Sakuraoka | 114/219 |
| 4,762,080 | 8/1988 | Pearson | 114/219 |
| 4,909,172 | 3/1990 | Hamby | 114/219 |
| 4,962,719 | 10/1990 | Hughes et al. | 114/343 |
| 5,076,195 | 12/1991 | Heyne | 114/361 |
| 5,357,890 | 10/1994 | Mason, Jr.et al. | 114/219 |
| 5,398,631 | 3/1995 | Miller | 114/219 |
| 5,485,801 | 1/1996 | Gibbs | 114/219 |

*Primary Examiner*—Sherman Basinger
*Attorney, Agent, or Firm*—John A. Haug

[57] ABSTRACT

A protective device (10) for preventing damage to the hull of a watercraft (12) is shown formed of elongated members (10*a*, 10*b*) of flexible material and having pressure sensitive structural adhesive on a side thereof for attaching the members to the surface of a watercraft. Member (10*a*) serves as a first protective member and is formed with a central section (13) having longitudinally extending cavity (30) to enable the member to conform to variously shaped hulls. One or more supplemental members (10*b*) are shown for attachment on each opposite side of the first protective member and serve as auxiliary protective members.

20 Claims, 2 Drawing Sheets

WATERCRAFT HULL PROTECTIVE APPARATUS

This application claims the benefit of U.S. provisional application No. 60/008,037, filed Oct. 30, 1995.

FIELD OF THE INVENTION

This invention relates generally to hull protective devices for watercraft and more particularly to hull protective apparatus used to protect various types of watercraft from damage upon beaching, traveling or mooring in shallow water.

BACKGROUND OF THE INVENTION

Watercraft owners often repeatedly expose their watercraft to damaging abrasion from sand, stones and other debris present in and around waterways through normal recreational use of their watercraft. This can be extremely damaging to the hull of the watercraft and very expensive to repair. Repair costs can range in the hundreds of dollars, even thousands of dollars, depending upon the extent of the damage. If left unrepaired and continuously exposed to this type of abrasion and damage, the watercraft may even sustain structural damage exposing passengers to danger and even to life threatening situations.

Watercraft manufacturers expend great effort and cost to produce a product having optimum performance and esthetic value. Owners of such watercraft take great pride in the performance and appearance of their watercraft investment and are strongly compelled to provide a high degree of care and maintenance to protect their own and their passengers' safety as well as to protect their investment and maintain the esthetic value and structural integrity of their watercraft.

Because of the damage that is likely to occur to the hull, including the bow and keel, from sand, stones and other debris present in and around waterways during beaching, traveling, mooring and through normal recreational use, there is a need to protect watercraft from such damage with a permanent device which will not adversely affect the convenient operation, performance and appearance of the watercraft.

Prior art attempts to protect the hulls of watercraft from the type of damage described above have been lacking for various reasons; for example, some have been too costly or too inconvenient and difficult to install; some have detracted from the esthetics of the watercraft or have been cumbersome or have adversely affected performance, speed, economy or safe handling of the watercraft and in general have not been commercially accepted.

Prior art protective devices, as described in U.S. Pat. Nos. 5,398,631; 5,076,195; 4,962,719; and 3,055,022 show sheet like devices which are temporarily positioned by means of ropes, cords or the like. Another device described in U.S. Pat. No. 5,357,890 provides an elongated member having a thicker central portion relative to respective side portions and having a V-shaped groove for positioning the member relative to the keel which is also temporarily attached to the watercraft by means of ropes or cords. Still another sheet like device is described in U.S. Pat. No. 3,220,026 and comprises a pear shaped sheet having a thickened central portion tapering to a feathered edge, and is attached to a hull by means of an adhesive. A device described in U.S. Pat. No. 4,909,172 comprises an elongated strip of flexible material having a pair of opposing walls diverging upwardly to form a V-shaped hollow to conform to the generally V-shape of the bow of a watercraft and is also attached by means of adhesive. Yet another device described in U.S. Pat. No. 4,762,080 provides a V-shaped, ablative member which alters the hydrodynamic performance of the watercraft hull and is temporarily attached by means of a removable adhesive.

The above devices all suffer from one or more disadvantages. Those that require ropes or cords for temporary fixation require special handling and storage and are inconvenient and difficult to position properly. The pear shape sheet of the '026 patent, although showing a thickened central portion has no provision for obtaining intimate conformance with complex surfaces of typical hulls along the keel; the V-shaped strip of the '172 patent has only minor surface portions in adhesive engagement with the boat surface and requires different configurations for different shaped hulls; and the ablative guard of the '080 patent not only alters the hydrodynamic behavior of the watercraft but also requires replacement. Thus, the prior art devices do not answer the need to obtain substantial protection of watercraft with an economical, conveniently installed, permanent protective device which will not adversely affect the convenient operation, performance and appearance of the watercraft.

SUMMARY OF THE INVENTION

It is an object of the present invention to provide protective apparatus for watercraft which overcomes the above noted prior art limitations. Another object is the provision of a protective device for watercraft which affords protection against abrasion and other such damage from sand, stones, tree branches and limbs and other such debris that may come in contact with the bow, keel and other portions of the hull of a watercraft while still allowing normal recreational use of the watercraft and without causing the owner of the watercraft worry, anxiety and fear of damage to the watercraft when beaching, traveling or mooring in and around shallow water, beaches, embankments, docks or in areas where abrasive of otherwise damaging materials may be present. Another object of the present invention is the provision of apparatus to protect the bottom surface of watercraft to which it is attached and as much of the adjacent bottom and side surfaces of the watercraft as desired according to the owner's judgment of needs considering performance, appearance and damage exposure of the watercraft. Yet another object is the provision of protective apparatus which can be permanently installed by individuals of average ability and without elaborate, expensive special tools, equipment or the like. Still another object is the provision of a protective device that will not adversely affect the esthetics or the performance, speed, stability, safe handling and/or fuel economy of the watercraft on which it is installed. Another object of the invention is the provision of a protective device which can be used with a wide variety of watercraft sizes, shapes and colors.

Briefly, in accordance with the invention, a hull protective apparatus comprises elongated members of a durable, resilient material such as polyvinylchloride (PVC) having a Shore A hardness in the range of approximately 71 to 100. According to a first embodiment of the invention a first protective member comprises a longitudinally extending extrusion having a first side with a generally flat surface and with a longitudinally extending, relatively thick central section. A second, opposed side of the central section has an outwardly extending convexly curved, opposed surface. Outer side walls, integrally attached to opposite sides of the central section, taper from the relatively thick central section to a relatively thin outer distal edge of the side walls. A longitudinally extending isolation groove is formed between the central section and the respective side walls. According to a feature of the invention a longitudinally extending cavity, open to the first side, is formed in the central section with longitudinally extending, opposed tabs extending over the cavity having distal end portions spaced a selected distance from one another. According to another feature of the invention, a recess is formed in the first surface to accommodate a layer of adhesive, preferably pressure sensitive, double coated acrylic foam. According to a modified embodiment of the invention, a second, supplemental protective member which can be optionally used with the first protective member, comprises elongated longitudinally extending extrusions, each having a first side with a generally flat surface with a recessed portion therein to accommodate a similar layer of adhesive. According to a feature of the modified embodiment, the second protective member is otherwise of uniform thickness approximately equal to the outer distal end of the side walls of the first protective member.

Additional objects and features of the invention will be set forth in part in the description which follows and in part will be obvious from the description. The objects and advantages of the invention may be realized and attained by means of the instrumentalities and combinations particularly pointed out in the appended claims.

BRIEF DESCRIPTION OF THE DRAWINGS

The accompanying drawings, which are incorporated in and constitute a part of the specification, illustrate preferred embodiments of the invention and, together with the description, serve to explain the objects, advantages and principles of the invention. In the drawings.

DETAILED DESCRIPTION OF THE PREFERRED EMBODIMENTS

Figure 1:
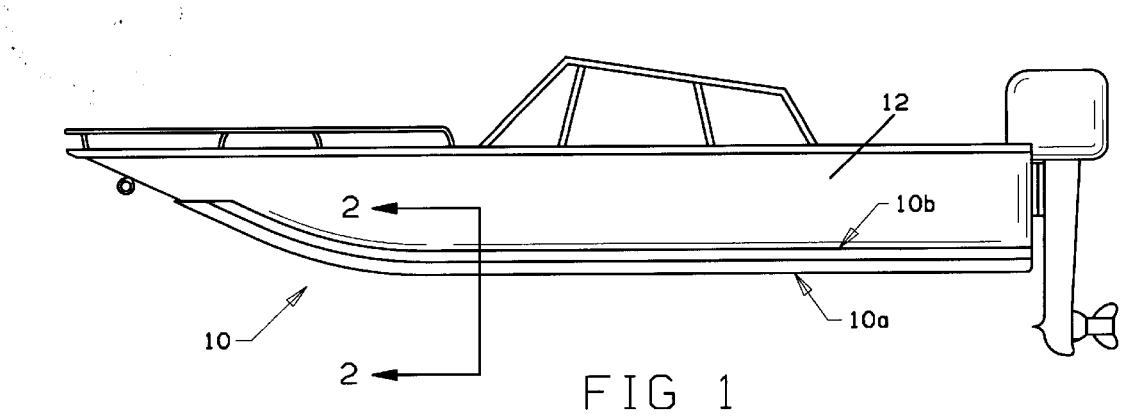
FIG. 1 is a side elevational view of a watercraft shown with a hull protective apparatus comprising first and second protective members made in accordance with the invention.
Figure 2:
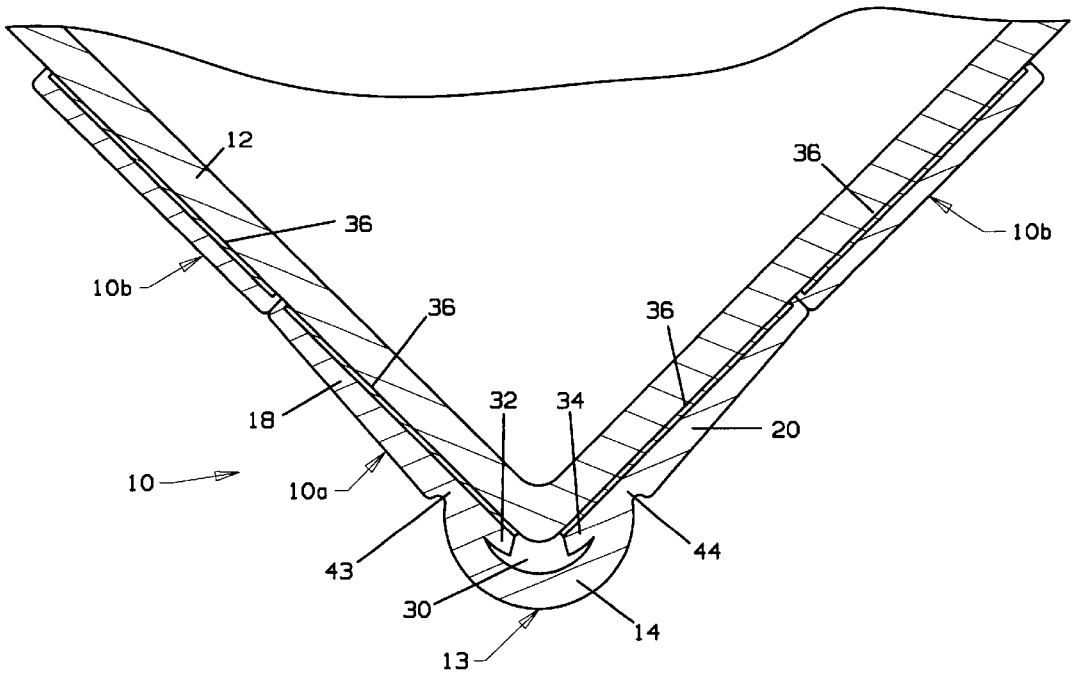
FIG. 2 is a cross-sectional view taken on line 2—2 of FIG. 1.

With reference particularly to FIGS. 1 and 2, protective apparatus, generally indicated by the numeral 10, is shown affixed to the hull of a watercraft 12 extending from bow to stern. According to a first embodiment of the invention the apparatus comprises a first protective member in the form of an elongated strip 10*a* of a durable, resilient material, such as polyvinylchloride (PVC) or polyurethane of any selected color. Member 10*a* is preferably extruded and preferably has a Shore A hardness in the range of approximately 71 to 100. Although member 10*a* can be of any selected width, approximately four inches is preferred. The member is provided in relatively long lengths adapted to be cut to any given length selected for a given watercraft, generally in the range of 60% to 100% of the length of the watercraft. Member 10*a* has a generally flat first side intended to be attached to the surface of a watercraft and a second side to provide suitable protection. A central section 13 of member 10*a* is formed with a longitudinally, outwardly extending curved convex wall configuration 14 (see FIG. 3) on the second opposed side thereof. The surface of the second side at the lateral center 16 is approximately ½ inch from the first side of member 10*a*. Wall 14 varies in thickness from approximately 3/16 inch at the lateral center to approximately ⅛ inch at the lateral distal ends 43, 44, respectively. Wall 14 is integrally connected to side wall portion 18 at 43 and to side wall portion 20 at 44 forming respective hinges. Both hinges 43 and 44 are defined by a respective isolation groove 22. Side wall portions 18, 20 are each approximately ¼ inch thick at a location contiguous to groove 22 and taper down to approximately ⅛ inch at the outer distal end thereof.

Figure 3:
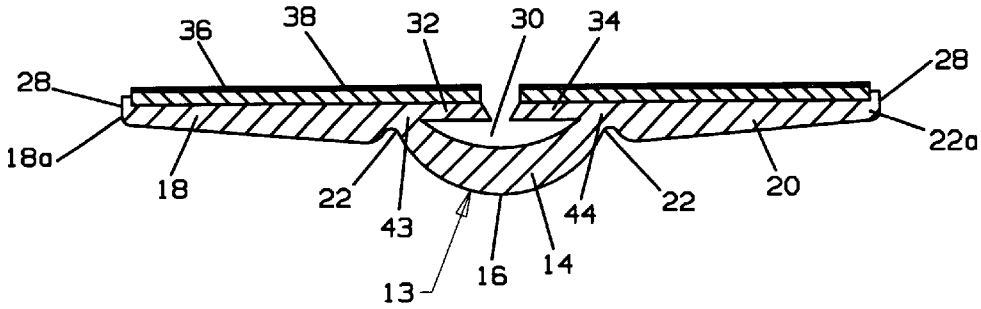
FIG. 3 is a cross-sectional view of the first protective member of the FIG. 1 protective apparatus prior to installation on a watercraft.
Figure 4:
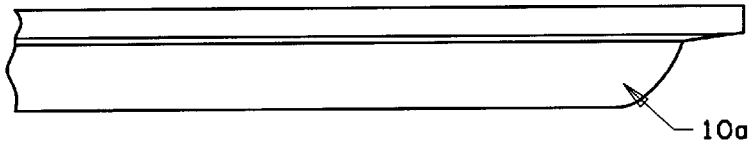
FIG. 4 is a side elevational view of a portion of the FIG. 3 apparatus.
Figure 5:
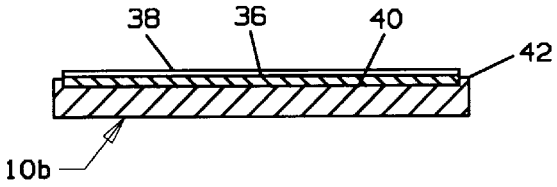
FIG. 5 is a cross-sectional view of the second protective member of the FIG. 1 protective apparatus prior to installation on a watercraft.
Figure 6:
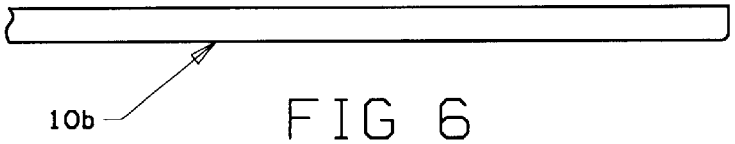
FIG. 6 is a side elevational view of a portion of the FIG. 5 apparatus.

As seen in FIG. 3, a recess 26 on the order of 0.045 inch in depth is formed in the first side for reception of suitable adhesive, to be discussed below, leaving a lip 28 extending longitudinally along the outer distal end of walls 18, 20.

According to a feature of the invention, a longitudinally extending cavity 30 is formed in central section 13 of member 10*a* having a concave bottom surface portion with tabs 32, 34 extending substantially over the cavity but having spaced apart distal end portions. The provision of cavity 30 allows member 10*a* to readily conform to the changing V-shape of the keel of the watercraft as one goes from the bow to the stern as well as different configurations from one craft to another. Furthermore, the cavity provides a cushion against impact with abrasive and otherwise damaging objects, providing durability and extending the useful life of the protective apparatus made in accordance with the invention. Longitudinally extending hinges 43, 44 formed by isolation grooves 22 provide additional flexibility and conformability to facilitate the application of member 10*a* to the watercraft. Furthermore, the hinges provide strain relief along the longitudinal outer surface of the central section 13. Tabs 32, 34 serve to increase the area of adhesive engagement with the hull of the watercraft without significantly adversely affecting the flexibility of the strip. The enhanced flexibility and conformance of member 10*a* provided by cavity 30 and tabs 32, 34, as well as the flexibility provided by hinges 43, 44 also increase resistance against shearing, peeling, abrasion, and cuts and enhance durability and therefore extend the useful life of the protective apparatus.

Adhesive strips 36 having a thickness at least equal to and preferably slightly greater than the depth of recess 26, i.e., 0.045 inch, are placed in recess 26 for securing strip 10*a* to a watercraft. Due to the high degree of stress exerted against the protective member during impact with solid objects and during high speed operation, adhesive strip 36 is preferably a high performance, pressure sensitive, double coated acrylic foam, structural adhesive. Examples of preferred adhesives are VHB tape available from 3M. VHB is a trademark of 3M for acrylic foam, structural adhesive tape. A release liner 38 is disposed on the outer surface of the adhesive to facilitate handling of the member prior to installation on a watercraft.

Lips 28, each approximately 0.030 inch in width, serve to protect edges of the adhesive strip 36 from impact of debris and water splash. In addition, lips 28 serve as a continuation of the edge wall surface 18*a*, 20*a*, respectively, covering the edge of the adhesive to thereby enhance the esthetic appearance of the apparatus.

Protective member 10*a* can be used separately to provide protection from abrasion and other damage caused by contact with sand, stones and the like or such protection can be extended, as desired, by protective members 10*b*. Members 10*b*, formed as elongated strips, are preferably composed of the same material as that of member 10*a* and also are formed preferably by extrusion. While members 10*b* can be of any selected width, a strip of approximately 2 inches wide has been found to be effective. Members 10*b* are also provided in relatively long lengths adapted to be cut to any desired length, generally coextensive with that of a corresponding member 10*a* for a given watercraft. Member 10*b* has a thickness of approximately ⅛ inch, the same thickness as the outer distal end of side walls 18, 20 of member 10*a*, so that one or more members 10*b* can be placed in juxtaposition to member 10*a* to provide a surface of the same height on the hull of the watercraft. Members 10*b* have a recess 40, also approximately 0.045 inch in depth and a lip 42 of approximately 0.030 inch in width extending along opposed side edges of strip 10*b*. Adhesive 36, the same adhesive as that used with member 10*a*, is adhered to the bottom surface of recess 40 and provided with a release liner 38 temporarily placed thereon.

Member 10*a*, and members 10*b* if supplemental protection is desired, are permanently attached to the hull of a watercraft using the following procedure.

Step 1. The surface of a selected watercraft hull is cleaned and prepared, particularly the area of intended attachment of members 10*a*, 10*b* using ordinary household cleaning products such as bathroom tub and tile cleaner, soap scum remover and alcohol.

Step 2. Beginning at the leading edge of the member, it is attached by sequentially peeling back protective release liner 38 approximately six inches from the leading edge of the self-sticking adhesive, and attaching member 10*a* lengthwise to the bottom most surface centering the member along the length of the hull, beginning at the bow at a point above the waterline and continuing along the centerline of the hull lengthwise toward the stern, repeating the sequence until member 10*a* is completely attached.

Step 3. Contact pressure is applied to member 10*a* by means of a J-shaped roller or wallpaper seam roller, applying maximum hand pressure to the member beginning at the bow and continuing along the member lengthwise toward the stern until contact pressure has been applied to the entire surface of the member.

Step 4. Supplemental members 10*b*, if desired, are attached, beginning at the leading edge of a member 10*b*, sequentially peeling back protective release liner 38 approximately six inches from the leading edge of the self-sticking adhesive and attaching member 10*b* to the surface of the hull lengthwise adjacent to the outer edge of member 10*a* on one side thereof and continuing rearwardly toward the stern of the watercraft, maintaining edge contact of both members 10*a* and 10*b* along the entire length, repeating the sequence until member 10*b* is completely attached. The process is then repeated for a second member 10*b* on the other side of member 10*a*.

Step 5. Contact pressure is applied to members 10*b* by means of a J-shaped roller or wallpaper seam roller, applying maximum hand pressure to members 10*b* beginning at the bow and continuing along members 10*b* lengthwise toward the stern until contact pressure has been applied to the entire surface of members 10*b*.

Step 6. Additional members 10*b*, if desired may be installed using the same procedure of steps 4 and 5 to extend the protected surface of the hull should the owner of the watercraft find that such protection is warrented in view of certain particular conditions and circumstances.

It will be seen that the above procedure can be carried out by individuals of average skill and without any elaborate tools or expensive equipment. Although the invention has been described with regard to certain specific preferred embodiments thereof, variations and modifications will become apparent to those skilled in the art. It is, therefore, the intention that the appended claims be interpreted as broadly as possible in view of the prior art to include all such variations and modifications.

What is claimed:

1. Apparatus for protecting the hull of a watercraft comprising an elongated member of flexible material having a first generally flat side intended to be attached to a watercraft surface and an opposite second side for providing protection from abrasion and impact with solid objects, the member having a longitudinally extending central section between and integrally attached to first and second longitudinally extending side wall portions by respective first and second longitudinally extending hinges of reduced thickness, the central section having an outwardly extending, generally convex surface configuration on the second side, a longitudinally extending cavity formed in the central section open to the first side, first and second tabs extending over the cavity, the tabs having distal end portions spaced from one another and adhesive material disposed on the first side for attaching the member to the surface of a watercraft.

2. Apparatus according to claim 1 in which the cavity has a generally concave bottom surface.

3. Apparatus according to claim 1 in which the flexible material of the member has a Shore A hardness in the range of approximately 71 to 100.

4. Apparatus according to claim 1 in which the adhesive material comprises a strip of pressure sensitive, self-sticking, acrylic foam.

5. Apparatus according to claim 4 further including a release liner disposed on the adhesive material.

6. Apparatus according to claim 1 in which a longitudinally extending isolation groove is formed in the second side of the member between the central section and each side wall portion.

7. Apparatus according to claim 1 in which a recess is formed in the first side to accommodate the adhesive material.

8. Apparatus according to claim 1 in which each side wall portion has a distal outer end and the thickness of the side wall portions tapers from a first thickness adjacent the central section to a thinner second thickness at the distal outer end of the side wall portions.

9. Apparatus according to claim 8 in which the first thickness is approximately ¼ inch and the second thickness is approximately ⅛ inch.

10. Apparatus according to claim 1 in which the central section has a center wall between lateral distal ends and the center wall is formed having a first thickness which tapers to a second thinner thickness at the respective lateral distal ends.

11. Apparatus according to claim 10 in which the first thickness is approximately 3/16 inch and the second thickness is approximately ⅛ inch.

12. Apparatus according to claim 10 in which the first and second hinge thickness is approximately ⅛ inch.

13. Apparatus according to claim 1 in which the flexible material of the member is polyvinylchloride.

14. Apparatus according to claim 1 in which the flexible material of the member is polyurethane.

15. Apparatus according to claim 1 in which the side wall portions have a distal outer end of a selected thickness and further comprising supplemental elongated members of flexible material having generally uniform thickness equal to the selected thickness of the distal outer end of the side wall portions, the supplemental elongated member having first and second opposed sides, the first side intended to be attached to the surface of a watercraft and the second side for providing protection from abrasion and impact with solid objects and adhesive material disposed on the first side of the supplemental members for attaching the supplemental members to the surface of the watercraft.

16. Apparatus according to claim 15 including a recess formed in the supplemental members on the first side thereof to accommodated the adhesive material.

17. Apparatus according to claim 15 in which the adhesive material on the supplemental members comprises a pressure sensitive, acrylic foam.

18. Apparatus according to claim 15 in which the flexible material of the supplemental members is polyvinylchloride.

19. Apparatus according to claim 15 in which the flexible material of the supplemental members is polyurethane.

20. Apparatus for protecting the hull of a watercraft comprising an elongated first member of flexible material having a first generally flat side intended to be attached to a watercraft surface and an opposite second side for providing protection from abrasion and impact with solid objects, the first member having a longitudinally extending central section between first and second longitudinally extending side wall portions, the side wall portions having a distal outer end of a selected thickness, the central section having an outwardly extending, generally convex surface configuration on the second side, a longitudinally extending cavity formed in the central section open to the first side, first and second tabs extending over the cavity, the tabs having distal end portions spaced from one another and supplemental elongated second members of flexible material having generally uniform thickness equal to the selected thickness of the distal outer end of the side walls and having first and second sides, the first side intended to be attached to the surface of a watercraft and the second side for providing protection from abrasion and impact with solid objects, the first and second members being generally coextensive in length and adhesive material disposed on the first side of each first and second member for attaching the first and second members to the surface of the watercraft.

* * * * *